US006595155B1

(12) United States Patent
Akers

(10) Patent No.: US 6,595,155 B1
(45) Date of Patent: Jul. 22, 2003

(54) COMBINATION SNAP AND FASTENER

(75) Inventor: Gentry H. Akers, Altamont Springs, FL (US)

(73) Assignee: Nelson A. Taylor Co., Inc., Gloversville, NY (US)

( * ) Notice: Subject to any disclaimer, the term of this patent is extended or adjusted under 35 U.S.C. 154(b) by 0 days.

(21) Appl. No.: 10/053,928

(22) Filed: Jan. 24, 2002

(51) Int. Cl.[7] ..... B63B 17/00
(52) U.S. Cl. ..... 114/361
(58) Field of Search ..... 114/343, 361; 24/306

(56) References Cited

U.S. PATENT DOCUMENTS 3,658,107 A 4/1972 Perina
3,851,357 A 12/1974 Ribich et al.
3,916,703 A 11/1975 Ribich et al.
4,047,259 A * 9/1977 Lotis ..... 15/104.92
4,522,008 A 6/1985 Zeigler
4,872,871 A 10/1989 Proxmire et al.
5,282,616 A 2/1994 Stacavich-Notaro
5,483,704 A 1/1996 Filipiak
5,537,793 A 7/1996 Murasaki
5,638,581 A 6/1997 Burke
D390,099 S 2/1998 Bailey et al.
5,839,388 A * 11/1998 Vadney ..... 114/361
6,138,882 A 10/2000 Buettner

* cited by examiner

*Primary Examiner*—Stephen Avila
(74) *Attorney, Agent, or Firm*—Nixon & Vanderhye P.C.

(57) ABSTRACT

A connector facilitates securing a boat canvas to a boat frame. One portion of a conventional snap is attached to a boat surface in a known manner. The complementary portion of the snap forms part of a two-sided connector, including a surrounding component with one half of a repositionable fastener facing away from the boat surface. In this manner, a boat canvas including the other half of the repositionable fastener can be readily secured to the boat. Preferably, a connecting force between the first and second halves of the repositionable fastener is greater than a connecting force of the first and second halves of the snap connector so that the two-sided connectors remain attached to the canvas when the canvas is removed. With this structure, the boat company can install the snaps in the windshield earlier in the boat assembly process, and the connector allows for adjustment in the field to compensate for shrinkage, stretching, etc. of the boat canvas.

10 Claims, 3 Drawing Sheets

COMBINATION SNAP AND FASTENER

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a connector for securing one item to another and, more particularly, to a snap connector incorporating a repositionable fastener.

Conventional boat canvas or canopy connectors include a snap fastener with a male snap member secured to a surface of the boat frame attachable to a corresponding female snap member fixed to the canvas. Alignment and installation of the female snap member on the cover can be difficult and time-consuming and typically must be done after the male snap members are secured to the boat frame. Moreover, once the female snap members are appropriately fixed to the canvas, the snap members can be shifted out of alignment by virtue of stretching or shrinking of the canvas, e.g., via exposure to environmental elements or the like. Moreover, stress points may be created on the boat canvas material in the area of the female snap members causing undue stress and possible separation of material at the snap.

BRIEF SUMMARY OF THE INVENTION

The present invention relates to a snap connector incorporating a repositionable fastener. In a preferred application, the snap connector is provided for securing a boat canvas or canopy to a boat frame and/or windshield (hereinafter generally "boat frame"). One portion of a conventional snap is attached to a surface such as a boat surface in a known manner. The complementary portion of the snap includes a surrounding component with one-half of a repositionable fastener facing away from the boat surface. In this manner, a boat canvas including the other half of the repositionable fastener can be readily secured to the boat. As a consequence, it allows the boat company to install the snaps in the windshield earlier in the boat assembly process by making the snap-to-canvas connection adjustable. Moreover, it allows for adjustment in the field to compensate for shrinkage.

In an exemplary embodiment of the invention, a connector for securing a boat canvas to a boat frame includes a first half of a snap connector fixable to the boat frame; a second half of the snap connector releasably engageable with the first half of the snap connector; and a first half of a repositionable fastener disposed surrounding the second half of the snap connector. The first half of the repositionable fastener is releasably engageable with a second half of the repositionable fastener secured to the boat canvas. A connecting force between the first and second halves of the repositionable fastener is greater than a connecting force of the first and second halves of the snap connector.

The second half of the snap connector is preferably disposed facing the first half of the snap connector, wherein the first half of the repositionable fastener is disposed facing an opposite direction. The first half of the repositionable fastener is preferably substantially centered with the second half of the snap connector.

In another exemplary embodiment of the invention, a boat windshield in combination with a boat canvas includes a windshield frame supporting a windshield; a first half of a snap connector fixed to the windshield frame; a second half of the snap connector releasably engageable with the first half of the snap connector; a first half of a repositionable fastener disposed surrounding the second half of the snap connector; and a boat canvas including a second half of the repositionable fastener. The first half of the repositionable fastener is releasably engageable with the second half of the repositionable fastener, and a connecting force between the first and second halves of the repositionable fastener is greater than a connecting force of the first and second halves of the snap connector.

In yet another exemplary embodiment of the invention, a method of securing a boat canvas including a second half of a repositionable fastener to a boat frame including a first half of a plurality of snap connectors is provided. In the method, a plurality of two-sided connectors are secured to the first half of the snap connectors, the two-sided connectors including a second half of the snap connectors on one side and a first half of the repositionable fastener on an opposite side. The boat canvas is positioned and secured by attaching the second half of the repositionable fastener to the first half of the repositionable fastener. The boat canvas may be optionally removed, wherein the two-sided connectors remain secured to the removed boat canvas via the first and second halves of the repositionable fastener.

Preferably, after optionally removing the boat canvas with the two-sided connectors attached, the method may include re-securing the boat canvas to the boat frame by attaching the two-sided connectors to the first half of the snap connectors. In another application, after optionally removing the boat canvas with the two-sided connectors attached, the method may include removing the two-sided connectors from the boat canvas, and re-securing the two-sided connectors to the first half of the snap connectors, thereby compensating for any shrinkage of the boat canvas.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
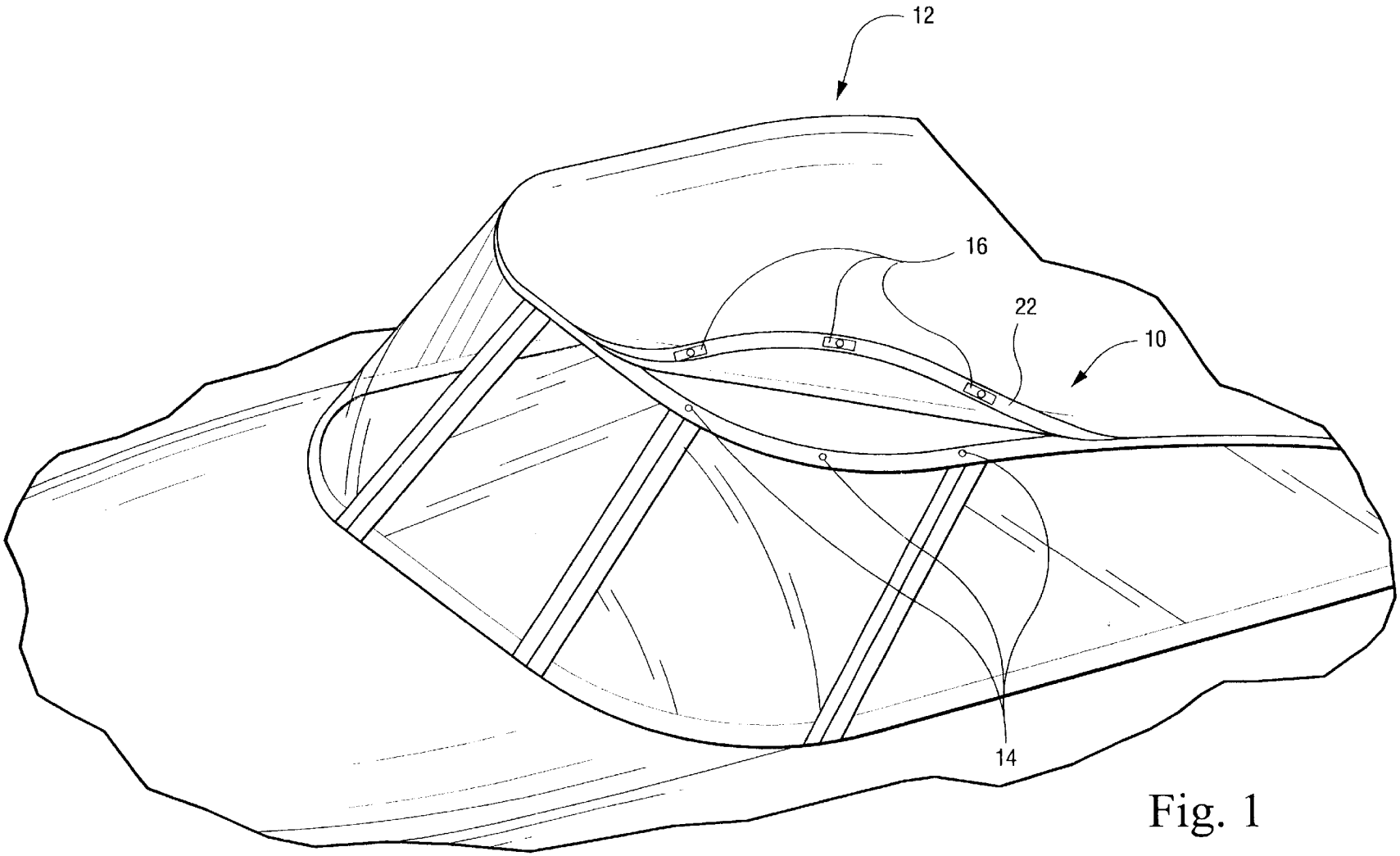
FIG. 1 is a perspective view of a boat with a boat canvas attachable to the boat frame.

With reference to FIG. 1, it may be desirable to secure a boat canopy or canvas 10 to a boat frame 12 to protect the deck and/or passengers from environmental elements. For this purpose, a connector element 14 such as a first half of a snap connector is secured to the boat frame 12 in any suitable manner. An example is shown in U.S. Pat. No. 5339,763, the entire contents of which are hereby incorporated by reference.

As discussed above in the context of the prior art connectors, a complementary half of the snap connector is typically fixed to the canvas, thereby enabling the canvas to be releasably secured to the boat frame. This construction, however, has the disadvantages discussed above.

Figure 2:
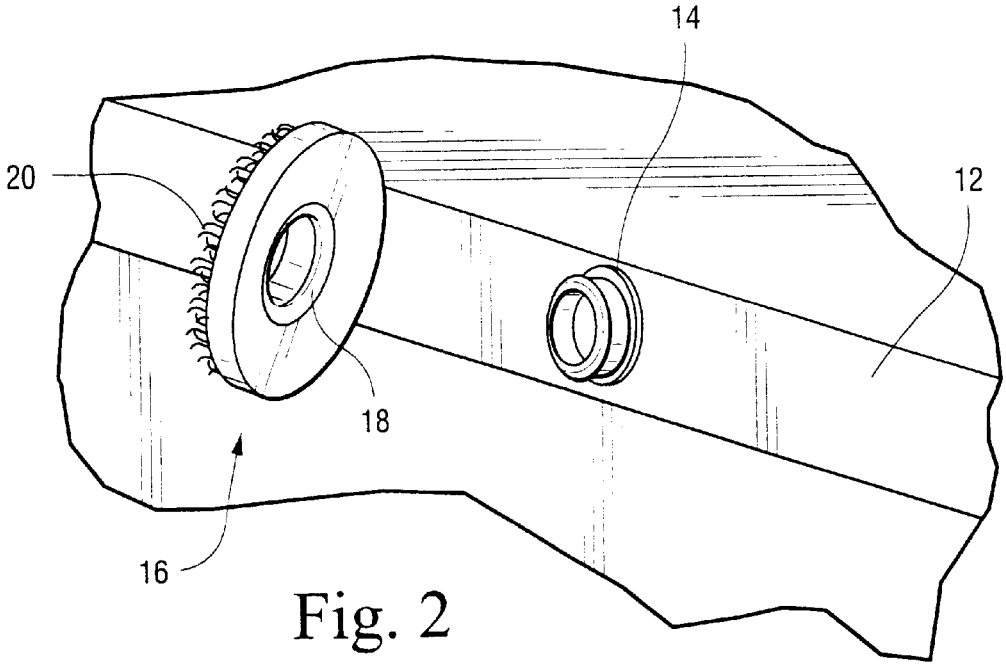
FIGS. 2 and 3 are perspective close-up views of the connector according to the present invention.
Figure 3:
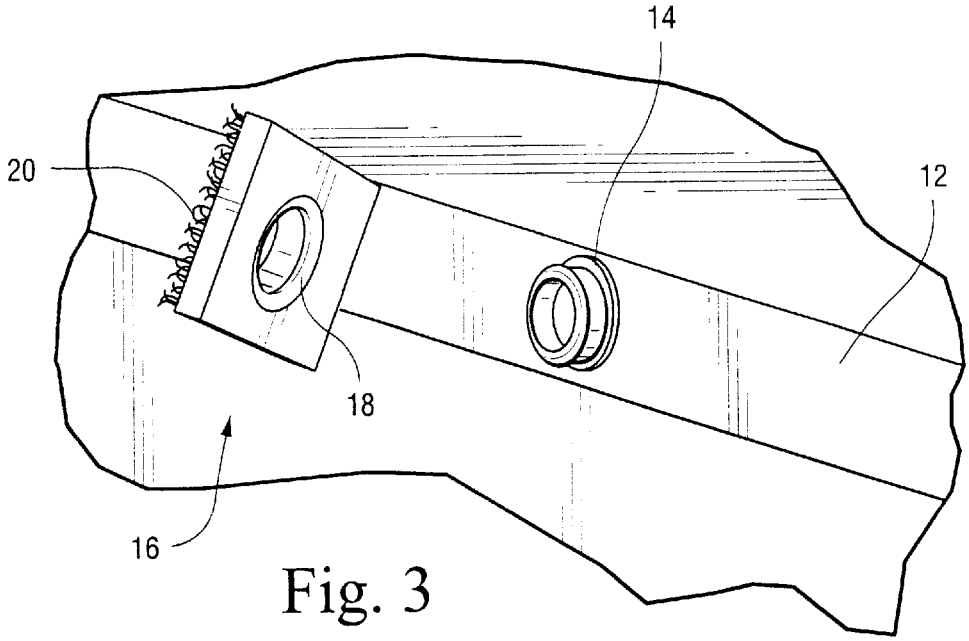

With reference to FIGS. 2 and 3, according to the present invention, a complementary or second half 18 of the snap connector is not permanently affixed to the canvas 10. Rather, the second half 18 of the snap connector forms part of a separate two-sided connector 16 on a side facing the first half 14 of the snap connector. The two-sided connector 16 is generally formed of a fabric or flexible plastic material or the like, and the second half connector 18 is fixed therein in any suitable manner. This complementary half 18 of the snap connector is releasably engageable with the first half 14 of the snap connector. A first half 20 of a repositionable fastener, such as a hook and loop fastener or the like, is provided on an opposite side of the two-sided connector 16 facing the boat canvas 10. As shown in FIG. 1, a second half 22 of the repositionable fastener is formed in a strip or the like adjacent a perimeter of the canvas 10.

In a preferred embodiment, a connecting force between the first 20 and second 22 halves of the repositionable fastener is greater than a connecting force of the first 14 and second 18 halves of the snap connector. As a consequence, if the canvas 10 is removed from the boat frame 12, the two-sided connectors 16 remain attached to the canvas 10.

As shown in FIGS. 2 and 3, the first half 20 of the repositionable fastener may be substantially centered with the second half 18 of the snap connector. As shown in FIG. 1, the first half 20 of the repositionable fastener may be formed of any suitable shape surrounding the second half 18 of the snap connector. For example, in FIGS. 1 and 3, the connector elements 16 are shown generally rectangular shaped, and in FIG. 2, the connector element 16 is shown generally circular shaped. Examples of suitable repositionable fasteners include Velcro®, available from the Velcro Corp., and Dual Lock®, available from 3M.

In operation, a plurality of the two-sided connectors 16 can be secured to the first half 14 of the snap connectors. In this manner, the first half 20 of the repositionable fasteners face away from the boat frame 12 toward the canvas 10. The canvas 10 can then be positioned and secured by attaching the second half 22 of the repositionable fastener to the first half 20 of the repositionable fastener along a perimeter of the boat canvas 10. In this manner, the manufacturing process for the boat canvas 10 can be made significantly easier.

Subsequently, the boat canvas 10 can be optionally removed, wherein the two-sided connectors 16 remain secured to the removed boat canvas 10 via the first 20 and second 22 halves of the repositionable fastener. To compensate for any shrinkage or the like of the boat canvas 10, after optionally removing the boat canvas 10 with the two-sided connectors 16 attached, the two-sided connectors 16 can be removed from the boat canvas and re-secured to the first halves 14 of the snap connectors, respectively. Subsequently, when the boat canvas 10 is re-positioned on the boat frame via the repositionable fasteners, the two-sided connectors 16 are effectively re-positioned on the canvas 10. Alternatively, after optionally removing the boat canvas 10 with the two-sided connectors 16 attached, the canvas can be readily re-secured to the boat frame 12 by attaching second halves 18 of the snap connectors in the two-sided connectors 16 to the first half 14 of the snap connectors secured to the boat frame 12.

With the construction according to the present invention, the first half of the snap connectors secured to the boat frame can be installed earlier in the boat assembly process by making the snap-to-canvas connection adjustable. Additionally, the manufacturing process for the canvas is made significantly easier. Still further, the system according to the present invention allows for adjustment in the field to compensate for shrinkage, stretching or the like.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. For example, although the connectors have been described in conjunction with a preferred application of securing a boat canvas to a boat and/or windshield frame, the invention is not necessarily meant to be limited to the described application. Rather, the connector according to the invention can be readily incorporated in place of any conventional snap-type fastener securing one element to another. Examples of other suitable applications include carpet installation/replacement, clothing, upholstery, etc.

What is claimed is:

1. A connector for securing a boat canvas to a boat frame, the connector comprising:

a first half of a snap connector fixable to the boat frame;

a second half of the snap connector releasably engageable with the first half of the snap connector; and a first half of a repositionable fastener disposed surrounding the second half of the snap connector, the first half of the repositionable fastener being releasably engageable with a second half of the repositionable fastener secured to the boat canvas, wherein a connecting force between the first and second halves of the repositionable fastener is greater than a connecting force of the first and second halves of the snap connector.

2. A connector according to claim 1, wherein the second half of the snap connector is disposed facing the first half of the snap connector, and wherein the first half of the repositionable fastener is disposed facing an opposite direction.

3. A connector according to claim 1, wherein the first half of the repositionable fastener is substantially centered with the second half of the snap connector.

4. A boat windshield in combination with a boat canvas, the combination comprising:

a windshield frame supporting a windshield;

a first half of a snap connector fixed to the windshield frame;

a second half of the snap connector releasably engageable with the first half of the snap connector;

a first half of a repositionable fastener disposed surrounding the second half of the snap connector; and a boat canvas including a second half of the repositionable fastener, wherein the first half of the repositionable fastener is releasably engageable with the second half of the repositionable fastener, and wherein a connecting force between the first and second halves of the repositionable fastener is greater than a connecting force of the first and second halves of the snap connector.

5. A combination according to claim 4, wherein the second half of the snap connector is disposed facing the first half of the snap connector, and wherein the first half of the repositionable fastener is disposed facing the boat canvas.

6. A combination according to claim 4, wherein the first half of the repositionable fastener is substantially centered with the second half of the snap connector.

7. A method of securing a boat canvas including a second half of a repositionable fastener to a boat frame including a first half of a plurality of snap connectors, the method comprising:

securing a plurality of two-sided connectors to the first half of the snap connectors, the two-sided connectors including a second half of the snap connectors on one side and a first half of the repositionable fastener on an opposite side;

positioning and securing the boat canvas by attaching the second half of the repositionable fastener to the first half of the repositionable fastener; and optionally removing the boat canvas, wherein the two-sided connectors remain secured to the removed boat canvas via the first and second halves of the repositionable fastener.

8. A method according to claim 7, further comprising, after optionally removing the boat canvas with the two-sided connectors attached, re-securing the boat canvas to the boat frame by attaching the two-sided connectors to the first half of the snap connectors.

9. A method according to claim 7, further comprising, after optionally removing the boat canvas with the two-sided connectors attached, removing the two-sided connectors from the boat canvas, and re-securing the two-sided connectors to the first half of the snap connectors, thereby compensating for any shrinkage of the boat canvas.

10. A connector for securing a first item to a second item, the connector comprising:

a first half of a snap connector fixable to the second item;

a second half of the snap connector releasably engageable with the first half of the snap connector; and a first half of a repositionable fastener disposed surrounding the second half of the snap connector, the first half of the repositionable fastener being releasably engageable with a second half of the repositionable fastener secured to the first item, wherein a connecting force between the first and second halves of the repositionable fastener is greater than a connecting force of the first and second halves of the snap connector.

* * * * *

UNITED STATES PATENT AND TRADEMARK OFFICE

CERTIFICATE OF CORRECTION

PATENT NO. : 6,595,155 B1
DATED : July 22, 2003
INVENTOR(S) : Akers

It is certified that error appears in the above-identified patent and that said Letters Patent is hereby corrected as shown below:

Title page,
Delete Item "[73] Assignee: Nelson A. Taylor Co., Inc.,
Gloversville, NY (US)"
and insert therefor Item
-- [73] Assignee: Nelson A. Taylor Co., Inc., a.k.a. N.A. Taylor Co., Inc.,
Gloversville, NY (US) --

Signed and Sealed this

Fourteenth Day of October, 2003

JAMES E. ROGAN
*Director of the United States Patent and Trademark Office*